US006061833A

United States Patent [19]

Smith et al.

[11] Patent Number: 6,061,833

[45] Date of Patent: May 16, 2000

[54] PROTECTIVE GLOVE WITH IMPROVED WRIST STRAP

[75] Inventors: Curtis R. Smith, Wellesley; James P. Lattari, Attleboro, both of Mass.

[73] Assignee: WDC Holdings, Inc., Attleboro Falls, Mass.

[21] Appl. No.: 09/213,541

[22] Filed: Dec. 17, 1998

[51] Int. Cl.[7] ..... A41D 19/00

[52] U.S. Cl. ..... 2/162; 2/16; 2/159

[58] Field of Search ..... 2/16, 159, 161.3, 2/161.6, 162, 167, 170; 224/175; 63/5.1, 5.2; 24/265 WS

[56] References Cited

U.S. PATENT DOCUMENTS

| | | | |
|---|---|---|---|
| 1,250,150 | 12/1917 | DuBois . | |
| 2,452,286 | 10/1948 | Benjamin | 63/5.2 |
| 2,521,144 | 9/1950 | Bergh | 63/5.2 |
| 3,885,383 | 5/1975 | Tanaka | 224/4 |
| 3,916,448 | 11/1975 | Hamel | 2/16 |
| 4,471,495 | 9/1984 | Kruse et al. . | |
| 4,493,865 | 1/1985 | Kuhlmann et al. | 2/16 |
| 4,723,406 | 2/1988 | Ripley | 59/79.1 |
| 4,843,650 | 7/1989 | Kangas et al. | 2/159 |
| 5,070,540 | 12/1991 | Bettcher et al. | 2/16 |
| 5,088,123 | 2/1992 | MacDonald . | |
| 5,511,241 | 4/1996 | Ziegler | 2/2.5 |
| 5,659,899 | 8/1997 | Soter et al. | 2/160 |
| 5,704,066 | 1/1998 | Yamamoto | 2/161.6 |

FOREIGN PATENT DOCUMENTS

| | | |
|---|---|---|
| PCT/EP95/04040 | 10/1995 | WIPO . |

*Primary Examiner*—John J. Calvert
*Assistant Examiner*—Katherine Moran
*Attorney, Agent, or Firm*—Iandiorio & Teska

[57] ABSTRACT

A protective glove with an improved strap, the glove having a glove portion made of mesh material, a wrist portion, and a continuous, flat, flexible, expandable band about the wrist portion.

2 Claims, 1 Drawing Sheet

PROTECTIVE GLOVE WITH IMPROVED WRIST STRAP

FIELD OF INVENTION

This invention relates to a protective glove including a continuous, flat, flexible, and expandable band forming a wrist strap for retaining the protective glove on the user's hand.

BACKGROUND OF INVENTION

Protective gloves and garments made of mesh material are used by butchers and meat packers and also in any industry where there is a risk of cuts or punctures or the like.

Since the mesh gloves are inherently flexible but also fairly heavy, they tend to hang from the user's hand and would fall off but for a securing strap. Various types of straps have been developed to secure the glove about the user's wrist and/or forearm.

The prior art, however, discloses a number of often unsuitable straps. For example, U.S. Pat. No. 1,250,150 shows a helical coil strap joined to the mesh portion of the glove, U.S. Pat. No. 5,088,123 shows the use of a spring as a glove stiffening element; U.S. Pat. No. 4,471,495 shows a cuff enclosing a strap with a fastener; and PCT/EP95/04040 shows the use of a helical spring as a strap inside the cuff portion of the glove.

In practice, the helical spring type strap is uncomfortable and somewhat gangly appearing thereby distracting from the glove's otherwise finished appearance. The other types of straps which include some kind of fastener (e.g. a buckle) and which must be adjusted and coupled and decoupled before and after use suffer from a variety of disadvantages because they must be adjusted and buckled and then unbuckled and because their useful life is often short especially when they are made of fabric.

SUMMARY OF INVENTION

It is therefore an object of this invention to provide a protective glove with an improved wrist strap.

It is a further object of this invention to provide such a strap which need not be adjusted prior to use.

It is a further object of this invention to provide such a strap which need not be coupled or decoupled from about the wearer's wrist.

It is a further object of this invention to provide such a strap which is more comfortable than prior art helical spring type straps.

It is a further object of this invention to provide such a protective glove with an improved strap which has a neat and finished appearance.

It is a further object of this invention to provide such a strap which is infinitely adjustable.

It is a further object of this invention to provide such a strap which has a longer useful life when compared to many prior art straps.

This invention results from the realization that a more comfortable and more finished appearing strap for a mesh material glove which does not require adjustment or fastening can be effected by making the strap out of a continuous, flat, flexible, and expandable band such as an elastic band or a watch band. The flatness of the elastic or watch band provides the user with significantly more comfort over a helical spring used as a wrist strap due to the increased surface area abutting the wearer's arm. In addition, elastic or the watch band provides the glove with a neat and finished appearance. Compared to adjustable straps with fasteners, the continuous, flexible, and expandable nature of the strap of this invention offers significant advantages to the user since the glove can be simply pulled over the user's hand and once in place the glove automatically and comfortably secures the wrist portion of the glove to a user's wrist of any size thereby providing the glove with a wide range of automatic adjustability. An elastic watch band also tends to last longer than many prior art straps.

In general, an elastic watch band or other similar strap provides the user with many of the advantages of a helically coiled spring strap but also provides the user with the comfort associated with prior art fabric straps.

A protective glove with an improved strap, the glove comprising a glove portion made of mesh material, a wrist portion, and a continuous, flat, flexible, expandable band about the wrist portion.

The wrist portion is also typically made of mesh material and may include a cuff made of mesh material. The continuous, flat, flexible, expandable band is preferably inside the cuff. The continuous, flat, flexible, expandable band may be a single elastic element or a series of connected elements biased into a position adjacent each other such as in a watch band.

This invention results in a more comfortable and more finished appearing strap for a mesh material glove which does not require adjustment or fastening since the strap is a continuous, flat, flexible, and expandable band such as an elastic or watch band. The flatness of the elastic or watch band provides the user with significantly more comfort over a helical spring used as a wrist strap. In addition, the elastic or watch band provides the glove with a neat and finished appearance. Compared to adjustable straps with fasteners, the continuous, flexible, and expandable nature of the strap of this invention offers significant advantages to the user since the glove can be simply pulled over the user's hand and once in place the glove automatically and comfortably but firmly secures the wrist portion of the glove to a user's wrist of any size thereby providing the glove with automatic adjustability. An elastic watch band also tends to last longer than many prior art straps. In general, an elastic or watch band or other similar strap provides the user with many of the advantages of a helically coiled spring strap but providing the comfort associated with prior art fabric straps.

DISCLOSURE OF PREFERRED EMBODIMENT

Other objects, features and advantages will occur to those skilled in the art from the following description of a preferred embodiment and the accompanying drawings, in which.

Figure 1:
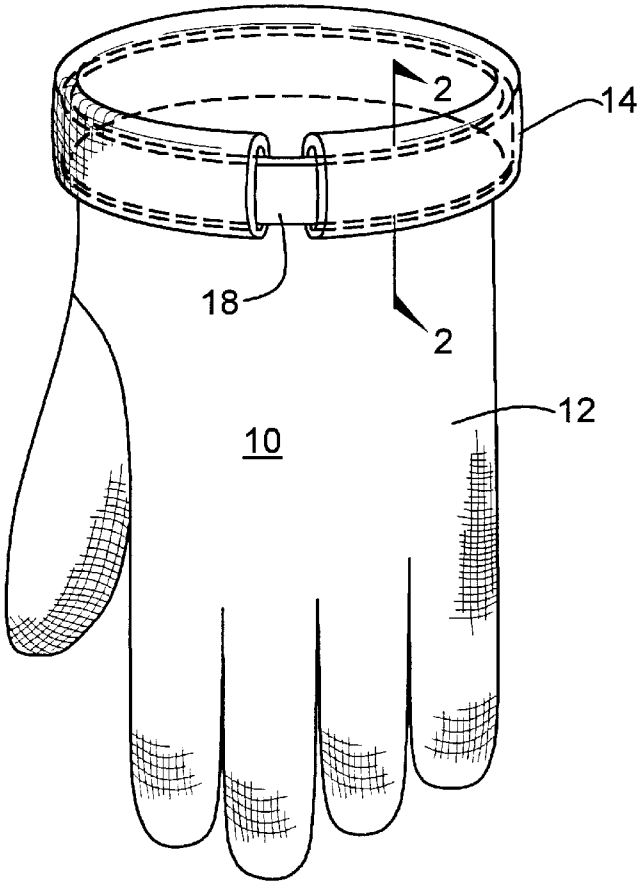
FIG. 1 is a schematic view of the protective glove of the subject invention.
Figure 2:
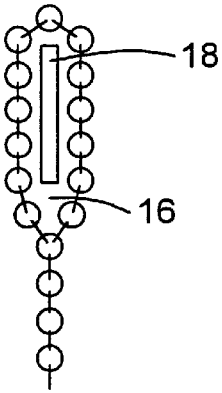
FIG. 2 is a view taken along line 2—2 of FIG. 1.

There shown in FIG. 1 the protective glove 10 of this invention including glove portion 12 made of metal mesh material and wrist portion 14 also typically made of metal mesh material and preferably forming cuff 16, FIG. 2. See U.S. Pat. No. 4,471,495 incorporated herein by this reference.

In one prior art glove, spring 20 was attached to the glove and used as a strap. See U.S. Pat. No. 1,250,150 incorporated herein by this reference. In another prior art glove, spring 20 was inserted into cuff 16. See PCT/EP95/04040 incorporated herein by this reference. In use, round spring 20 proved to be uncomfortable to the user.

Figure 4:
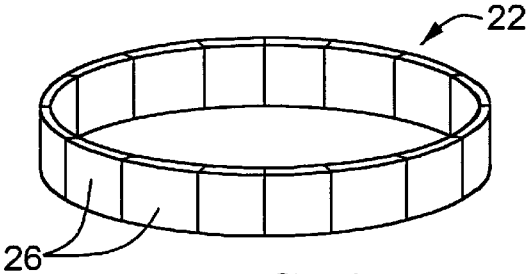
FIG. 4 is a schematic view of one embodiment of the improved wrist strap of the subject invention.

In the subject invention, strap 18 is a continuous, flat, flexible, and expandable band such as watch band 22, FIG. 4 available from Hirsch Speidel, Inc., Providence, R.I. or a single elastic element 24 (e.g. a large, wide, industrial strength rubber band).

Watch band 22 includes a plurality of elements or segments 26 connected in series and biased into a position adjacent to each other but expandable such that each element is separable from each adjacent element.

Strap 18 preferably resides inside cuff 16, FIG. 2 of wrist portion 14, FIG. 1 but may also be connected to the terminal end of sleeve portion 14 if cuff 16 is not present. Alternatively, there could be loops on the sleeve portion which assist in retaining strap 18 in place similar to belt loops.

Other similar straps may be used to secure the forearm portion of protectable gloves having extensions which encircle the user's forearm. See U.S. Pat. No. 5,088,123 incorporated herein by this reference.

Figure 5:
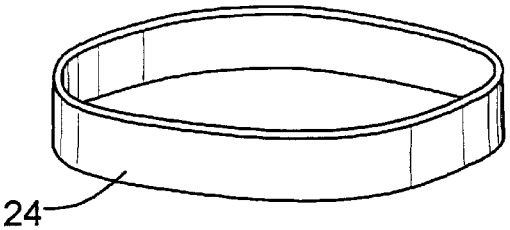
FIG. 5 is a schematic view of a second embodiment of the improved strap of the subject invention.

Continuous, flat, flexible, and expandable band 22, FIG. 4, or 24, FIG. 5 provides the user with a more comfortable glove which has a neat, finished appearance. Bands 22 and 24 need not be adjusted prior to use, need not be coupled or decoupled, and are instead widely and automatically adjustable and tend to last longer than simple springs and even last longer than many of the other types of prior art straps.

Figure 3:
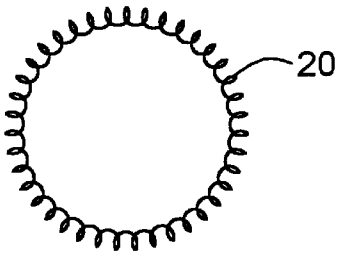
FIG. 3 PRIOR ART
FIG. 3 is a schematic view of a prior art helical spring type wrist band.

In this invention, flat strap 22, FIG. 4 or flat strap 24, FIG. 5 both include the automatic adjustability feature of helical spring 20, FIG. 3 but improve on that design by increasing the comfort level of the glove since there is nothing to bind or press into the user's wrist. Instead, the increased surface area of the strap provides a secure and comfortable engagement of the glove with the user's wrist and/or forearm. Moreover, straps 22 and 25 require no adjustment and there is nothing which need be buckled before use or unbuckled after use.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A protected glove with an improved strap, the glove comprising:

a glove portion made of mesh material;

a wrist portion made of mesh material including a cuff made of mesh material; and a continuous, flat, flexible, expandable band inside the cuff.

2. A protective glove with an improved strap, the glove comprising:

a glove portion made of mesh material;

a wrist portion; and a single elastic element forming a continuous, flat, flexible, expandable band about the wrist portion.

* * * * *